US011767956B2

(12) United States Patent
Chen

(10) Patent No.: US 11,767,956 B2
(45) Date of Patent: Sep. 26, 2023

(54) VEHICLE LED LAMP

(71) Applicant: SHENZHEN LIANSHANG PHOTOELECTRIC CO., LTD., Guangdong (CN)

(72) Inventor: Chaodong Chen, Guangdong (CN)

(73) Assignee: SHENZHEN LIANSHANG PHOTOELECTRIC CO., LTD., Guangdong (CN)

( * ) Notice: Subject to any disclaimer, the term of this patent is extended or adjusted under 35 U.S.C. 154(b) by 0 days.

(21) Appl. No.: 17/742,599

(22) Filed: May 12, 2022

(65) Prior Publication Data

US 2023/0046163 A1 Feb. 16, 2023

Related U.S. Application Data

(63) Continuation of application No. PCT/CN2022/076898, filed on Feb. 18, 2022.

(30) Foreign Application Priority Data

Aug. 16, 2021 (CN) ..... 202121919313.9

(51) Int. Cl.
*F21S 41/148* (2018.01)
*F21V 23/00* (2015.01)
(Continued)

(52) U.S. Cl.
CPC ..... *F21S 41/148* (2018.01); *F21S 41/192* (2018.01); *F21V 23/009* (2013.01); *F21Y 2115/10* (2016.08)

(58) Field of Classification Search
CPC ..... F21S 41/148; F21S 41/192; F21V 23/009
See application file for complete search history.

(56) References Cited

U.S. PATENT DOCUMENTS 5,113,330 A * 5/1992 Makita ..... B60Q 1/115 362/265
5,343,370 A * 8/1994 Ohashi ..... B60Q 1/0041 362/265

(Continued)

FOREIGN PATENT DOCUMENTS

CN 203147567 U 8/2013
CN 203836814 U 9/2014

(Continued)

OTHER PUBLICATIONS

International Search Report cited in PCT/CN2022/076898 dated Apr. 28, 2022, 5 pages.

(Continued)

*Primary Examiner* — Bryon T Gyllstrom
(74) *Attorney, Agent, or Firm* — COOPER LEGAL GROUP, LLC

(57) ABSTRACT

The present application relates to a vehicle LED lamp, and particularly to the technical field of lighting lamps. The vehicle LED lamp includes a terminal, a driver module and a LED light-emitting board which are connected in turn. The LED light-emitting board is cylindrical, one end of the driver module is embedded into the LED light-emitting board, and the other end is embedded into the terminal. The terminal is sleeved on one end of the LED light-emitting board and connected to a vehicle power supply in forward or reverse connection. The present applicant can realize the split assembly of the vehicle lamp.

7 Claims, 9 Drawing Sheets

(51) Int. Cl.
*F21S 41/19* (2018.01)
*F21Y 115/10* (2016.01)

(56) References Cited

U.S. PATENT DOCUMENTS 5,442,525 A * 8/1995 Tsukada ..... F21S 41/192 362/267
6,252,350 B1 * 6/2001 Alvarez ..... F21K 9/232 313/498
6,371,636 B1 * 4/2002 Wesson ..... B60Q 1/44 362/543
6,580,228 B1 * 6/2003 Chen ..... H01L 25/0753 362/240
6,893,143 B2 * 5/2005 Opolka ..... F21L 4/027 362/208
7,040,790 B2 * 5/2006 Lodhie ..... F21K 9/23 362/249.05
8,240,887 B2 * 8/2012 Daily ..... F21V 17/14 362/364
8,439,512 B2 * 5/2013 Isogai ..... F21K 9/60 362/240
2002/0060912 A1 * 5/2002 Becker ..... H01J 61/04 362/610
2011/0068687 A1 * 3/2011 Takahasi ..... F21V 29/89 315/35
2011/0089831 A1 * 4/2011 Takahasi ..... F21V 29/507 315/35
2015/0252953 A1 9/2015 Progl et al.

FOREIGN PATENT DOCUMENTS

CN 107435822 A 12/2017
CN 206943856 U 1/2018
CN 208418552 U 1/2019
CN 209926101 U 1/2020
CN 212746312 U 3/2021
CN 113587039 A 11/2021
DE 202014105629 U1 2/2015
JP H04272601 A 9/1992

OTHER PUBLICATIONS

European Search Report of Patent Family EP 22721638.9 dated Dec. 21, 2022, 4 pages.

* cited by examiner

VEHICLE LED LAMP

CROSS-REFERENCE TO RELATED APPLICATION

The present application is a continuation of PCT application No. PCT/CN2022/076898, filed on Feb. 18, 2022, which claims the priority and benefit of Chinese patent application serial No. 202121919313.9, filed on Aug. 16, 2021. The entireties of PCT application No. PCT/CN2022/076898 and Chinese patent application serial No. 202121919313.9 are hereby incorporated by reference herein and made a part of this specification.

TECHNICAL FIELD

The present application relates to the technical field of lighting lamps, and particularly to a vehicle LED lamp.

BACKGROUND

A vehicle lamp is one of the most common parts of a vehicle. Generally, a vehicle lamp has an integrated package structure, which has a higher cost. A vehicle lamp with an integrated package structure is inconveniently maintained after being damaged, and is required to replace the entire vehicle lamp. Further, the process of the integrated packaging involves a high temperature processing, which will cause damages to parts in the vehicle lamp.

SUMMARY

In order to achieve a split assemble of a vehicle lamp, the present application provides a vehicle LED lamp.

A vehicle LED lamp according to the present application adopts the following technical solution.

A vehicle LED lamp includes a terminal, a driver module and a LED light-emitting board that are electrically connected in sequence; the LED light-emitting board is cylindrical; one end of the driver module is embedded into the LED light-emitting board, and the other end of the driver module is embedded into the terminal; and the terminal is sleeved on one end of the LED light-emitting board and is in a positive or negative connection with a vehicle power supply.

In the above technical solution, during used, the driver module is connected to the vehicle power supply, and the driver module supplies power to the LED light-emitting board and then lights it up. The terminal and the housing protect the inner LED light-emitting board and the driver module. One end with opening of the LED light-emitting board is inserted into the terminal, and the LED light-emitting board is connected to the driver module to achieve a split assembling of the vehicle lamp.

In an example, the terminal is provided with a housing, the housing covers the LED light-emitting board, and an insulating base is provided between the terminal and the LED light-emitting board.

In the above technical solution, the housing covers the LED light-emitting board, so as to protect the LED light-emitting board.

In an example, the housing is adhered to an opening of the terminal for fixing.

In the above technical solution, the housing and the terminal can be fixed by bonding to improve the fixing of the housing.

In an example, the housing includes a plurality of fixing rings that are sleeved on the LED light-emitting board along a circumferential direction of the LED light-emitting board, and a connecting bar is fixedly provided between adjacent fixing rings.

In the above technical solution, the housing is provided as a combined structure of the fixing ring and the connecting bar, a part of the LED light-emitting board with lighting function and not covering the fixing ring and the connecting bar is taken as a light source of the LED light-emitting board, so as to improve the lighting function of the vehicle lamp and protect the inner parts of the vehicle lamp.

In an example, the housing is made of a transparent material.

In the above technical solution, the transparent housing can hermetically protect the LED light-emitting board to reduce the damaging possibility of the LED light-emitting board. Further, the housing of the vehicle lamp is made of the transparent material to improve the lighting function of the vehicle lamp.

In an example, the terminal is cylindrical, limiting blocks are fixedly provided on both sides of the terminal, a power interface with a circular sheet shape is fixedly provided on one end of the terminal away from the housing, the power interface is fixedly connected to the terminal, and the power interface is electrically connected to the driver module.

In the above technical solution, the end of the terminal providing with the power interface is inserted into the outer mounting structure of a vehicle body, the power interface is connected to the vehicle power supply, and the driver module is connected to the power interface, so as to supply power to the driver module. By providing the terminal as a cylindrical shape, the vehicle lamp can apply to the mounting structure of a cylindrical inserting groove. By providing the limiting block, the terminal is fixed on the outer mounting structure of the vehicle body.

In an example, a flat extension part is fixedly provided on one end of the terminal away from the housing, four pins are inserted into the extension part; one end of each of the pins is inserted into the terminal and electrically connected to the driver module, and the other end of each of the pins is in a bending shape and embedded into one side of the extension part.

In the above technical solution, when used, one end of the terminal provided with the extension part is inserted into the outer mounting structure of the vehicle body. The pin is connected to the vehicle power supply, so as to supply power to the driver module via the pin. By providing the flat extension part, the vehicle lamp can apply to the mounting structure of a flat inserting groove.

In an example, a side surface of one end of the terminal away from the housing is recessed inward to form a plurality of arc concaves.

In the above technical solution, the both sides of the terminal are provided as arc concave shape, so that the terminal can better fit in hands during the detaching process, and the convenience of the detaching process, repairing and maintenance of vehicle lamp can be improved.

In an example, a first limiting sheet and a second limiting sheet are fixedly provided on each of two sides of the extension part; a thickness of the first limiting sheet gradually increases along a direction close to the terminal and a thickness of the second limiting sheet gradually decreases along the direction close to the terminal.

In the above technical solution, during used, the extension part is inserted into the outer mounting structure of the vehicle body. The setting of the first limiting sheets and the second limiting sheets can play a position limiting role to the extension part. The first limiting sheet with gradually varying thickness plays a role in supporting and guiding in the process of inserting the extension into the outer mounting structure of the vehicle body, so that the relative protrusion degree of the second limiting sheet is reduced, and the installation of the vehicle lamp is smoother and more convenient. When the vehicle lamp needs to be detached, the second limiting sheet with gradually varying thickness plays a role in supporting and guiding, so that the relative protrusion degree of the first limiting sheet is reduced, and the detaching of the vehicle lamp is smoother and more convenient.

In an example, the LED light-emitting board is formed by bending and folding a rectangular aluminum substrate; a part to be folded of the rectangular aluminum substrate comprises two connecting parts to be folded inward, and a wire solder joint is provided on each of the connecting parts.

In the above technical solution, by using the LED light-emitting board made of the rectangular aluminum substrate, the shape of the LED light-emitting board can better fit in the terminal and the driver module.

In summary, the present application includes at least one of beneficial technical effects:

one end with opening of the LED light-emitting board is inserted into the terminal, so the LED light-emitting board is connected to the driver module. Then the housing is sleeved on the LED light-emitting board, the housing is connected to the terminal, and the connecting part is coated with glue, so as to achieve a split assembling of the vehicle lamp;

the housing is provided as a combined structure of the fixing ring and the connecting bar, a part of the LED light-emitting board with lighting function and not covering the fixing ring and the connecting bar is taken as a light source of the LED light-emitting board, so as to improve the lighting function of the vehicle lamp and protect the inner parts of the vehicle lamp; and the both sides of the terminal are provided as arc concave shape, so that the terminal can better fit in hands during the detaching process, and the convenience of the detaching process, repairing and maintenance of vehicle lamp can be improved.

DETAILED DESCRIPTION

The present application is further described in detail below with references to the drawings 1-9.

The present application provides a vehicle LED lamp.

Embodiment 1

Figure 1:
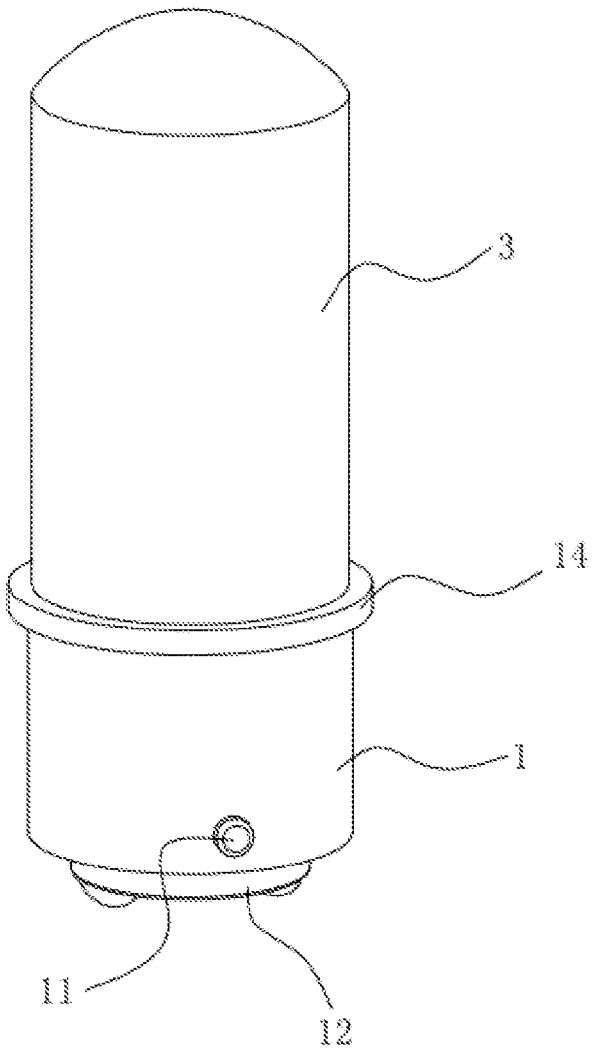
FIG. 1 is a schematic structure diagram according to an Embodiment 1 of the present application.
Figure 2:
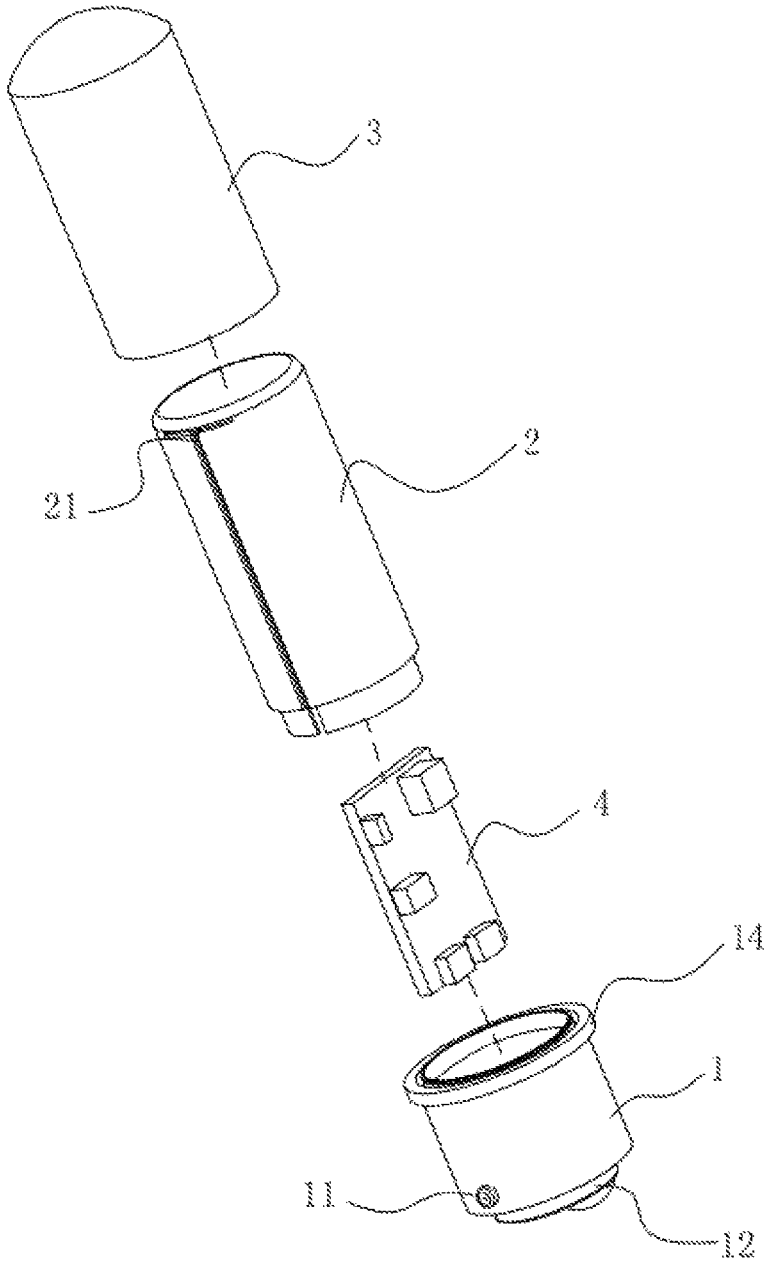
FIG. 2 is a schematic exploded view according to the Embodiment 1 of the present application.

Referring to FIGS. 1-2, a vehicle LED lamp includes a terminal 1, a LED light-emitting board 2 and a housing 3. One end of the LED light-emitting board 2 is arranged in the terminal 1. The housing 3 is sleeved on the LED light-emitting board 2 and is connected to one open end of the terminal 1. The terminal 1 may be in a positive or a negative connection with a vehicle power supply. In assembling, one end of the LED light-emitting board 2 is inserted into the terminal 1, the housing 3 is sleeved on the LED light-emitting board 2, and the terminal 1 is inserted into an outer mounting structure of the vehicle.

Referring to FIG. 2, the terminal 1 is cylindrical, and is provided with a plurality of fixed limiting blocks 11 on an outer wall of the terminal 1. The plurality of limiting blocks 11 are evenly distributed along a circumference of the terminal 1. A power interface 12 with a circular sheet shape is fixedly provided at one end of the terminal 1 away from the housing 3. A driver module 4 is provided in the terminal 1, which is connected to the power interface 12.

In assembling, one end of the terminal 1 that is provided with the power interface 12 is inserted into the outer mounting structure of the vehicle, the terminal 1 is fixed by the limiting blocks 11, and the power interface 12 is connected to the driver module 4 to supply power to the driver module 4.

Figure 3:
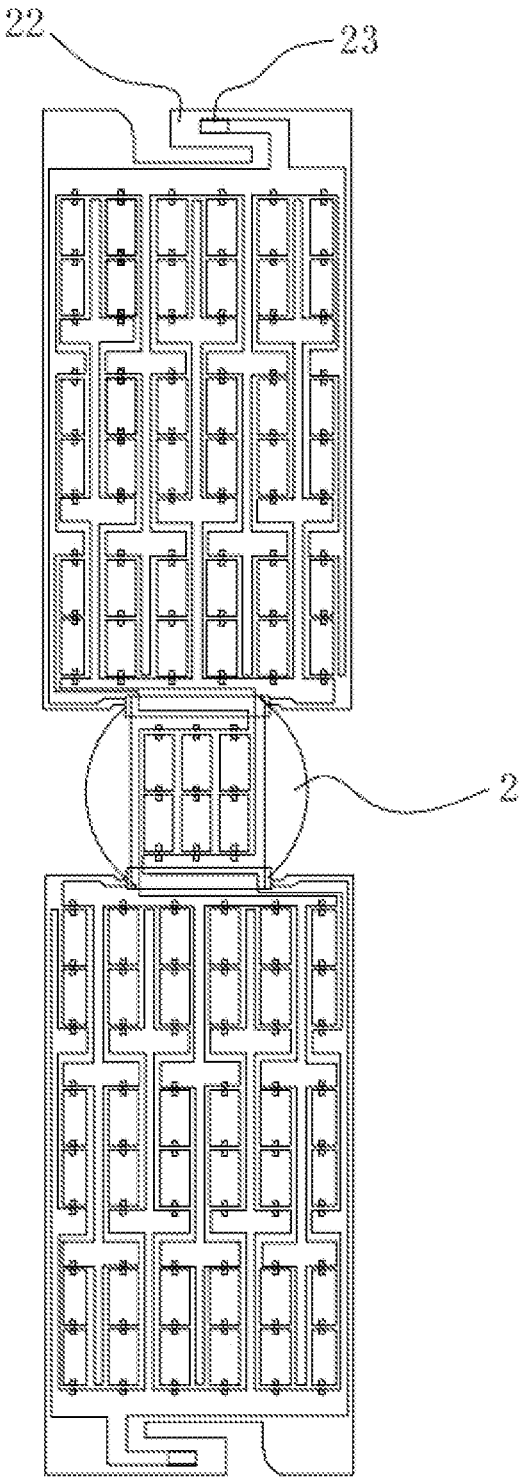
FIG. 3 is a schematic structure diagram of a LED light-emitting board according to the Embodiment 1 of the present application.

Referring to FIG. 2, the LED light-emitting board 2 is bent into a cylindrical shape with an opening at one end and gaps 21 on both sides. The open end of the LED light-emitting board 2 is arranged in the terminal 1. An insulating base 14 made of ceramic material is provided between the LED light-emitting board 2 and the terminal 1. The open end of the LED light-emitting board 2 is arranged in the insulating base 14. The outer side of the LED light-emitting board 2 is coated with a glue protective layer. The driver module 4 is connected to the LED light-emitting board 2. Referring to FIG. 3, the LED light-emitting board 2 is formed by bending and folding a rectangular aluminum substrate. A part to be folded includes two connecting parts 22 to be folded inward, and a wire solder joint 23 is provided on each of the two connecting parts 22.

In assembling, the LED light-emitting board 2 is bent into a cylindrical with an opening at one end, the open end of the LED light-emitting board 2 is inserted into the insulating base 14 of the terminal 1, the driver module 4 is connected to the LED light-emitting board 2 for supplying power to the LED light-emitting board 2 so that the LED light-emitting board 2 is lighted up. The glue protective layer on the outer side of the LED light-emitting board 2 protects and seals up the LED light-emitting board 2.

Referring to FIG. 2, the housing 3 is a cylindrical with an opening at one end and made of transparent material. The open end of the housing 3 is fixedly connected to one end of the insulating base 14, and the connection portion between the housing 3 and the insulating base 14 is coated with an adhesive.

In assembling, with installing of the LED light-emitting board 2 on the terminal 1, the housing 3 is sleeved on the LED light-emitting board 2, the adhesive is applied on the open end of the housing 3, and the end applied with the adhesive of the housing 3 is connected to the open end of the terminal 1 for fixing of the housing 3. When the LED light-emitting board 2 is lighted up, lights transmit through the housing made of the transparent material to realize the lighting function of the vehicle lamp.

The implement principle of the vehicle LED lamp according to an embodiment of the present application is described below. In use, the LED light-emitting board 2 is bent into a cylindrical with an opening at one end, the open end of the LED light-emitting board 2 is inserted into the terminal 1, and the LED light-emitting board 2 is connected to the driver module 4; the adhesive is applied on the open end of the housing 3, and the open end of the housing 3 is connected to the open end of the terminal 1, which achieves a split assembling of the vehicle lamp. In assembling, one end of the terminal 1 provided with the power interface 12 is inserted into the outer mounting structure of the vehicle, so that the power interface 12 is connected to the vehicle power supply; the vehicle power supply supplies power to the driver module 4, and further to the LED light-emitting board 2; and the LED light-emitting board 2 is lighted up to realize the lighting function of the vehicle lamp.

Embodiment 2

Figure 4:
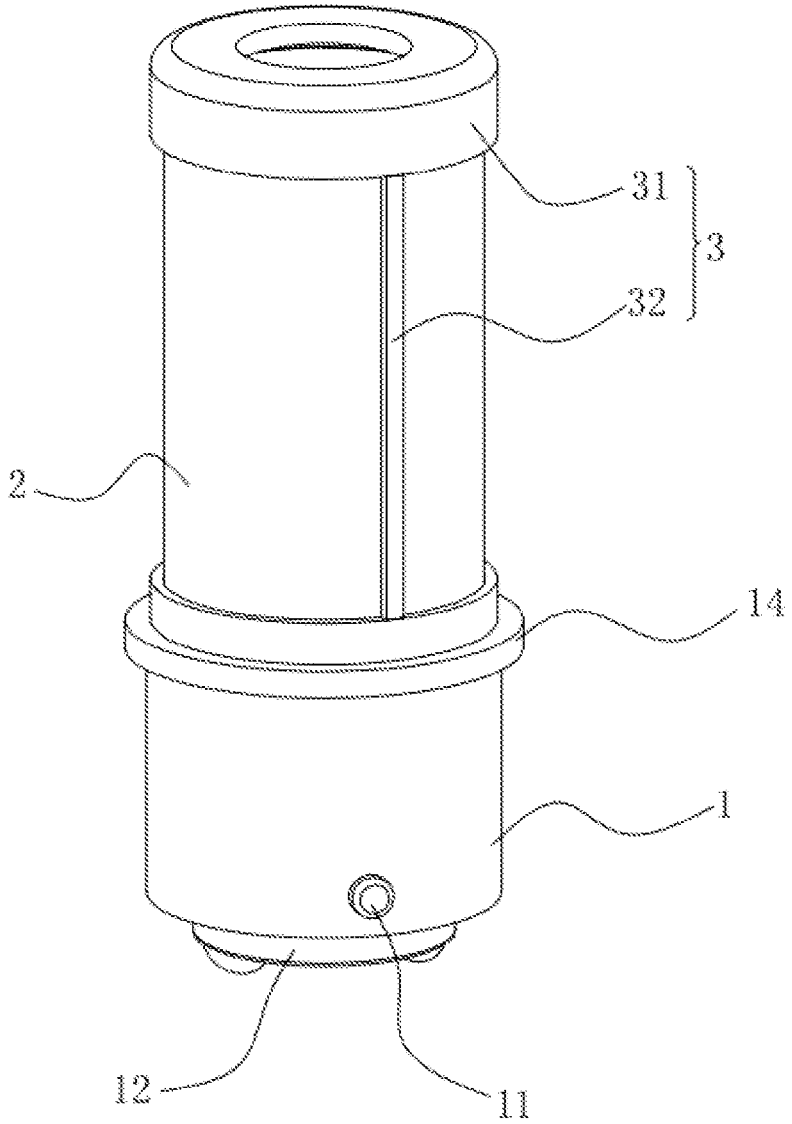
FIG. 4 is a schematic structure diagram according to an Embodiment 2 of the present application.
Figure 5:
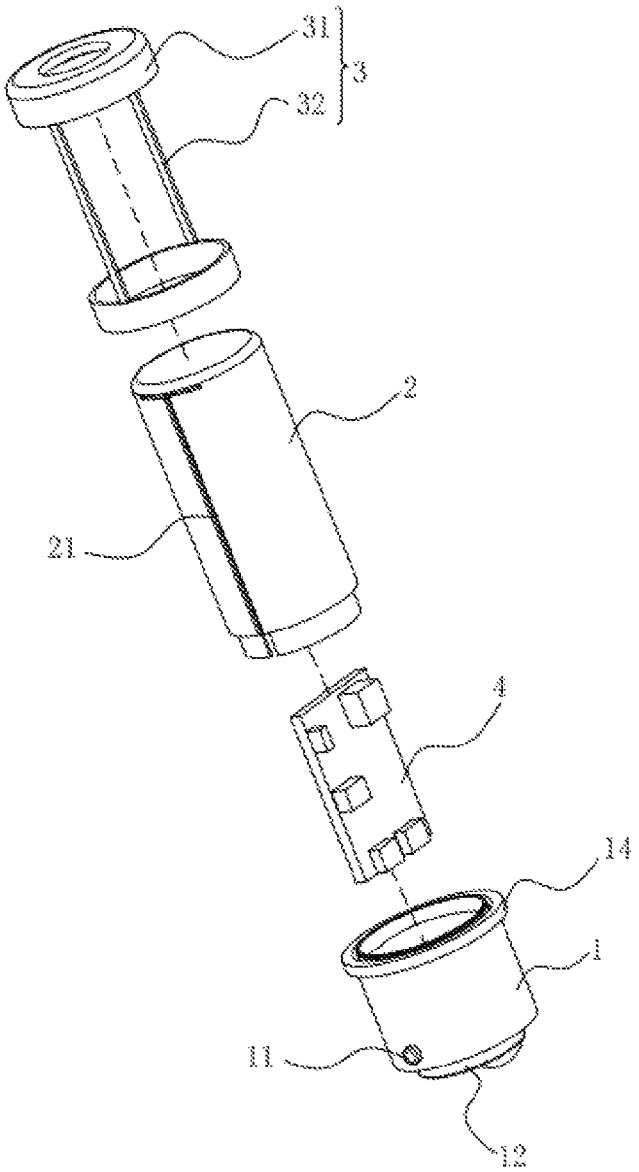
FIG. 5 is a schematic exploded view according to the Embodiment 2 of the present application.

Referring to FIGS. 4-5, Embodiment 2 is different from Embodiment 1 in that: the housing 3 includes two fixing rings 31 that are coaxially arranged along a length direction of the terminal 1, one of the fixing rings 31 is sleeved on an end of the LED light-emitting board 2 away from the terminal 1, and the other fixing ring 31 is connected to one end of the insulating base 14; a plurality of connecting bars 32 are provided between the two fixing rings 31, one end of each of the connecting bars 32 is fixedly connected to one of the fixing ring 31, and the other end of each of the connecting bars 32 is fixedly connected to the other fixing ring 31; the plurality of connecting bars 32 are evenly distributed along the circumferential direction of the fixing ring 31; the plurality of connecting bars 32 are arranged along the length direction of the terminal 1, and the plurality of connecting bars 32 are arranged to align with the gaps 21 on the both sides of the LED light-emitting board 2.

In assembling, the adhesive is applied on one of the fixing rings 31 of the housing 3, and the fixing ring 31 applied with the adhesive is fixedly connected to the open end of the terminal 1 for fixing the housing 3. The fixing rings 31 and the connecting bars 32 cover the gaps 21 on the both sides of the LED light-emitting board 2 so as to prevent foreign objects from entering the interior of the vehicle lamp. In use, a part of the LED light-emitting board 2 that is not covered by the fixing rings 31 and the connecting bars 32 can directly light up.

Embodiment 3

Figure 6:
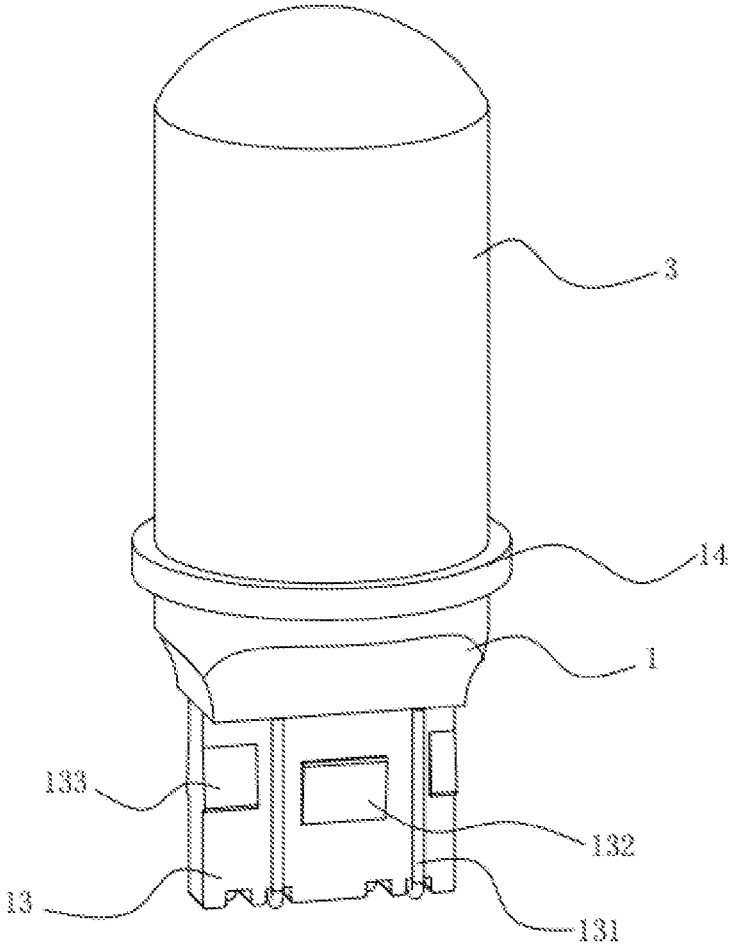
FIG. 6 is a schematic structure diagram according to an Embodiment 3 of the present application.
Figure 7:
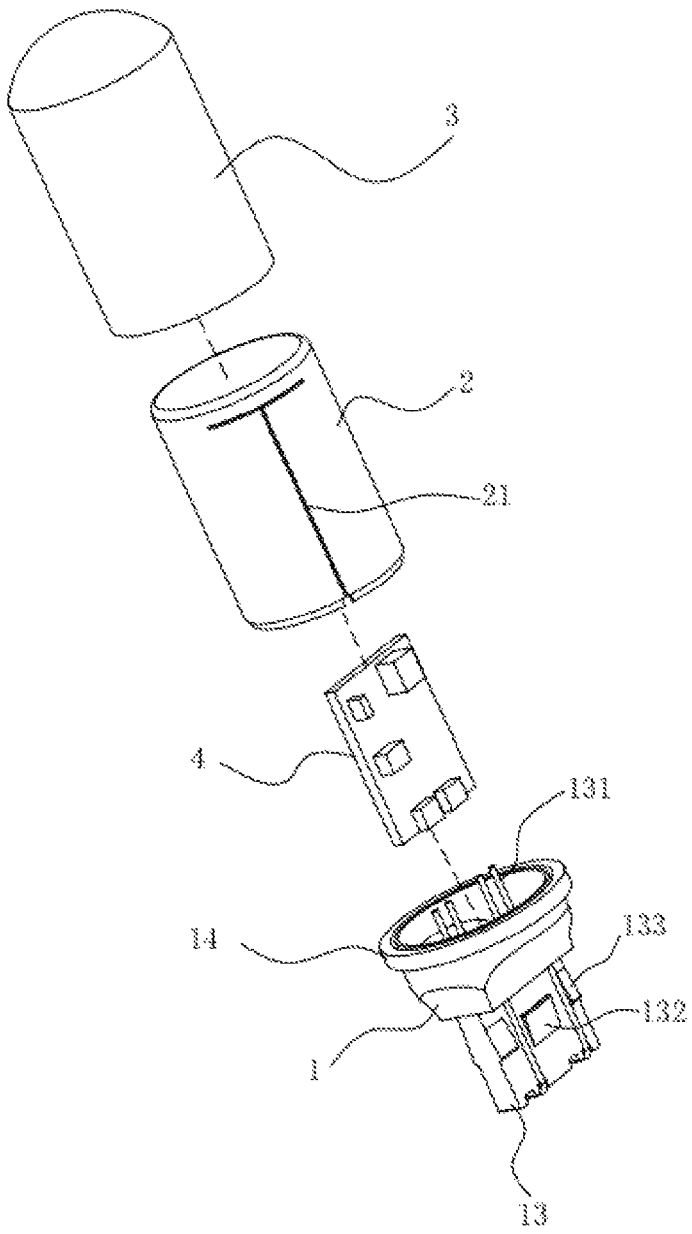
FIG. 7 is a schematic exploded view according to the Embodiment 3 of the present application.

Referring to FIGS. 6-7, Embodiment 3 is different from Embodiment 1 in that: a cross section of an end of the terminal 1 away from the housing 3 gradually decreases along a direction away from the housing 3, and both sides of one end of the terminal 1 away from the housing 3 are in an arc-concave shape; a flat extension part 13 is provided at the end of the terminal 1 away from the housing 3; a plurality of pins 131 is fixedly provided on the extension part 13; one end of each of the pins 131 is positioned in the extension part 13, inserted into the terminal 1 and connected to the driver module 4; and the other end of each of the pins 131 is in a bending shape and embedded into one side of the extension part 13.

In assembling, one end of the terminal 1 provided with the extension part 13 is inserted into the outer mounting structure of the vehicle, the pins 131 are connected to the vehicle power supply, so as to supply the power to the driver module 4 via the pins 131; in disassembling of the vehicle lamp, the operator places their fingers on the two arc-concave sides of the terminal 1, and the vehicle lamp can be convenient to be disassembled.

Referring to FIG. 6, the extension part 13 is fixedly provided with a first limiting sheet 132 and second limiting sheets 133 on both sides. The first limiting sheet 132 is positioned at a central part of the extension part 13, and the second limiting sheets 133 are positioned at two ends of the extension part 13. The thickness of the first limiting sheet 132 gradually increases along a direction close to the terminal 1 and the thickness of the second limiting sheets 133 gradually decreases along the direction close to the terminal 1.

In mounting of the vehicle lamp, one end of the extension part 13 away from the terminal 1 is inserted into the outer mounting structure of the vehicle. In inserting of the extension part 13 into the outer mounting structure of the vehicle, the first limiting sheet 132 with a gradually varied thickness plays a role in supporting and guiding, so that the relative protrusion degree of the second limiting sheet 133 is reduced, which facilitates the installation of the vehicle lamp. In disassembling of the vehicle lamp, the second limiting sheet 133 with a gradually varied thickness plays a role in supporting and guiding, so that the relative protrusion degree of the first limiting sheet 132 is reduced, which facilitates disassembling of the vehicle lamp.

Embodiment 4

Figure 8:
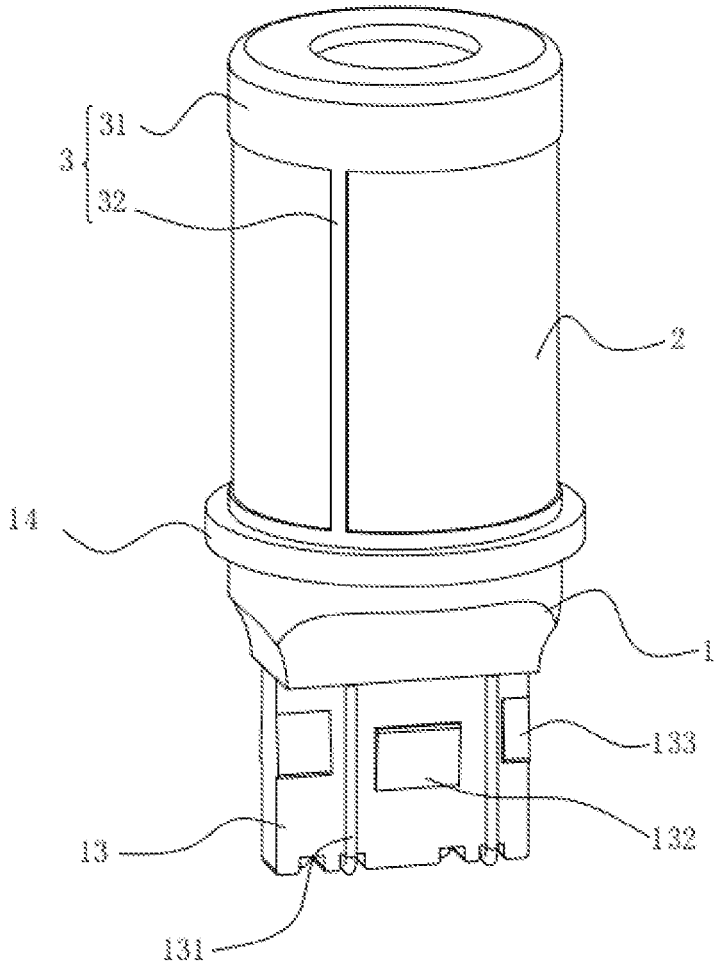
FIG. 8 is a schematic structure diagram according to an Embodiment 4 of the present application.
Figure 9:
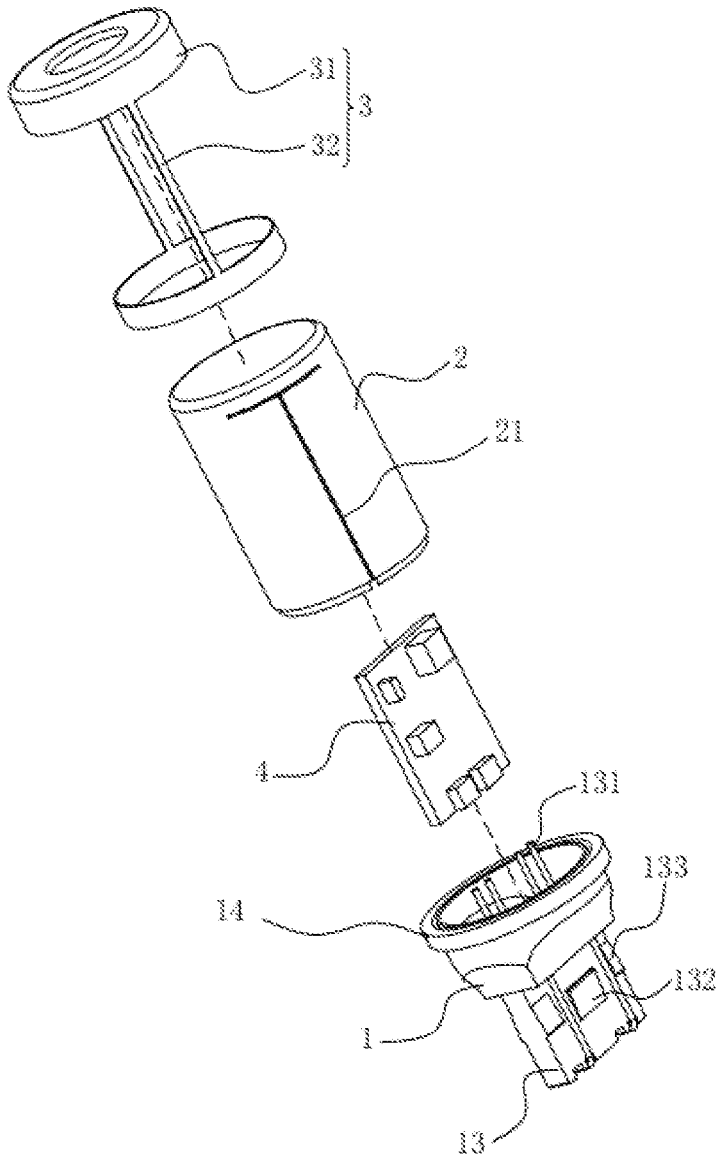
FIG. 9 is a schematic exploded view according to the Embodiment 4 of the present application.

Referring to FIGS. 8-9, Embodiment 4 is different from Embodiment 3 in that: the housing 3 includes two fixing rings 31 that are coaxially arranged along the length direction of the terminal 1; one of the fixing rings 31 is sleeved on one end of the LED light-emitting board 2 away from the terminal 1, and the other fixing ring 31 is connected to the open end of the terminal 1; a plurality of connecting bars 32 is fixedly provided between the two fixing rings 31, one end of each of the connecting bars 32 is fixedly with one fixing ring 31, and the other end of each of the connecting bars 32 is fixedly with the other fixing ring 31; the plurality of connecting bars 32 are evenly distributed along the circumferential direction of the fixing ring 31; the plurality of connecting bars 32 are arranged along the length direction of the terminal 1; and the plurality of connecting bars 32 are arranged to align with the gaps 21 on the both sides of the LED light-emitting board 2.

In assembling, the adhesive is applied on one of the fixing rings 31 of the housing 3, and the fixing ring 31 applied with the adhesive is fixedly connected to the open end of the terminal 1 for fixing the housing 3. The fixing rings 31 and the connecting bars 32 cover the gaps 21 on the both sides of the LED light-emitting board 2 so as to prevent foreign objects from entering the interior of the vehicle lamp. In use, a part of the LED light-emitting board 2 that is not covered by the fixing rings 31 and the connecting bars 32 can directly light up.

The above are the preferred embodiments of the present application, which are not intended to limit the protection scope of the present application. Therefore, all equivalent changes made according to the structure, shape and principle of the present application should be covered within the protection scope of the present application.

LIST OF REFERENCE SIGNS

1. Terminal; 11. Limiting block; 12. Power interface; 13. Extension part; 131. Pin; 132. First limiting sheet; 133.

Second limiting sheet; 14. Insulating base; 2. LED light-emitting board; 21. Gap; 22. Connecting part; 23. Wire solder joint; 3. Housing; 31. Fixing ring; 32. Connecting bar; 4. Driver module.

What is claimed is:

1. A vehicle light emitting diode (LED) lamp, comprising:

a terminal, a driver module and a LED light-emitting board that are electrically connected in sequence; wherein, the LED light-emitting board is cylindrical; one end of the driver module is embedded into the LED light-emitting board, and a second end of the driver module is embedded into the terminal; and the terminal is sleeved on one end of the LED light-emitting board and is in a positive or negative connection with a vehicle power supply, wherein, the terminal is provided with a housing, the housing covers the LED light-emitting board, and an insulating base is provided between the terminal and the LED light-emitting board, the housing is adhered to an opening of the terminal for fixing, and the housing comprises a plurality of fixing rings that are sleeved on the LED light-emitting board along a circumferential direction of the LED light-emitting board, and a connecting bar is fixedly provided between adjacent fixing rings.

2. The vehicle LED lamp according to claim 1, wherein, the housing is made of a transparent material.

3. The vehicle LED lamp according to claim 2, wherein, a side surface of one end of the terminal away from the housing is recessed inward to form a plurality of arc concaves.

4. The vehicle LED lamp according to claim 1, wherein, the terminal is cylindrical, limiting blocks are fixedly provided on both sides of the terminal, a power interface with a circular sheet shape is fixedly provided on one end of the terminal away from the housing, the power interface is fixedly connected to the terminal, and the power interface is electrically connected to the driver module.

5. The vehicle LED lamp according to claim 1, wherein, a flat extension part is fixedly provided on one end of the terminal away from the housing, four pins are disposed in the flat extension part; one end of each of the four pins is inserted into the terminal and electrically connected to the driver module, and a second end of each of the four pins is in a bending shape and embedded into one side of the flat extension part.

6. The vehicle LED lamp according to claim 5, wherein, a first limiting sheet and a second limiting sheet are fixedly provided on each of two sides of the flat extension part; a thickness of the first limiting sheet gradually increases along a direction close to the terminal and a thickness of the second limiting sheet gradually decreases along the direction close to the terminal.

7. The vehicle LED lamp according to claim 1, wherein, the LED light-emitting board is formed by bending and folding a rectangular aluminum substrate; a part to be folded of the rectangular aluminum substrate comprises two connecting parts to be folded inward, and a wire solder joint is provided on each of the two connecting parts.

* * * * *